US005708914A

United States Patent [19]

Mills et al.

[11] Patent Number: 5,708,914

[45] Date of Patent: Jan. 13, 1998

[54] ELECTROSTATOGRAPHIC APPARATUS HAVING FUSING PROCESS AND SYSTEM FOR IMPROVED TONER OFFSET CONTROL

[75] Inventors: Borden H. Mills, Webster; Douglas E. Bugner, Rochester; William J. Staudenmayer, Pittsford; George P. Kasper, Rochester, all of N.Y.

[73] Assignee: Eastman Kodak Company, Rochester, N.Y.

[21] Appl. No.: 639,069

[22] Filed: Apr. 24, 1996

[51] Int. Cl.[6] ..... G03L 15/20

[52] U.S. Cl. ..... 399/45; 399/67; 399/325

[58] Field of Search ..... 399/45, 325, 67

[56] References Cited

U.S. PATENT DOCUMENTS

| | | | |
|---|---|---|---|
| 4,825,227 | 4/1989 | Fischbeck et al. | 346/1.1 |
| 5,124,716 | 6/1992 | Roy et al. | 346/1.1 |

FOREIGN PATENT DOCUMENTS

| | | | |
|---|---|---|---|
| 58-200263 | 11/1983 | Japan | 355/284 |
| 58-200265 | 11/1983 | Japan | 355/284 |
| 60-129769 | 7/1985 | Japan | 355/284 |
| 6-202516 | 7/1994 | Japan | 355/284 |

*Primary Examiner*—Joan H. Pendegrass
*Attorney, Agent, or Firm*—Leonard W. Treash, Jr.

[57] ABSTRACT

A process and system for inhibiting toner offset in a electrostatographic apparatus of the kind wherein toner images are contact fused to a copy sheet. Drops of offset inhibiting liquid are discretely directed to predetermined locations on the contacting surface of the apparatus fuser member. For example, a drop on demand, piezoelectric drop generator can controllably jet drops of silicone oil to form desired offset inhibiting patterns in accord with apparatus control signals, indicative of particular copy sheet and image requirements.

17 Claims, 3 Drawing Sheets

ELECTROSTATOGRAPHIC APPARATUS HAVING FUSING PROCESS AND SYSTEM FOR IMPROVED TONER OFFSET CONTROL

FIELD OF THE INVENTION

The present invention relates to electrostatographic apparatus and more particularly to structures and methods for improved control of toner offset and fixing during the fusing operations of such apparatus.

BACKGROUND OF INVENTION

Electrostatographic apparatus, e.g. electrophotographic copiers and printers, can produce a copy sheet having a toner image, previously formed on an image member (e.g. a photoconductive insulator member) and transferred electrostatically to the copy sheet. In some applications, the image can comprise a plurality of different color toner particles, and the sheet can be opaque or transparent. It is desirable to fuse such toner image or images to the copy sheet became the electrostatic forces are not sufficient to hold the toner particles against mechanical forces, such as rubbing, that the sheet surface will experience.

While a variety of other fusing techniques have been used (e.g. radiant fusing, solvent vapor fusing, ultrasonic fusing), the most common fusing techniques utilize the combination of heat and pressure applied in the nip of opposing fuser and pressure members such as roller or belt members. The toner particles are melted and pressed to engage the fibers of the paper; however, some of the heated toner particles can unwantedly adhere to the member that contacts them in the fusing nip, for example a fuser roller. When a subsequent copy sheet passes into contact with toner adhering to the fuser member, such toner is transferred onto that sheet to form an undesirable artifact termed "offset".

To minimize toner offset, the surface of the fuser rollers have been formed of abhesive materials such as silicone rubber or poly(tetrafluoroethylene). Also, opposite electrostatic charges have been applied to the fuser rollers to repel the charged toner particles. However, the more common approaches utilize a combination of special abhesive roller surfaces and the application of a continuous, thin film coating of release liquid, such as a silicone oil, on the roller(s). Such thin oil films have been applied by means of a capillary wick, by an applicator roller, by an oiling web and by an aerosol spray applicator (see U.S. Pat. No. 4,085,702).

As described in the '702 patent, contact applicators such as wicks, rollers and webs can abrade the interfacing surfaces. Moreover the contamination of the applicator that results from such contact often causes an undesired variability in flow of offset preventing oil, necessitating frequent replacement of the applicator (e.g. the wick). Moreover, much of the applied oil is wasted by being applied to areas not needing it for proper toner release, e.g. to areas not presenting a toner/fuser interface.

To avoid the contamination difficulties posed by contact applicators, the system of the '702 patent causes an oil/water emulsion to be atomized into an aerosol spray directed toward the fuser roller. The spray can be actuated periodically, e.g. to apply predetermined quantities of spray in accord with the frequency of operation of the fuser device. Multiple spray nozzles or a transversing nozzle construction are provided to afford full coverage of the fusing roller. This approach offers significant advantages with respect to contamination problems. However, the '702 patents approach does not obviate the problem of wasted offset-inhibiting oil.

SUMMARY OF INVENTION

One significant purpose of the present invention is to provide improved apparatus and methods for applying offset preventing liquids to fuser devices, thereby obviating the above-noted difficulties of prior art systems. Another related object of the present invention is to provide methods and apparatus for applying offset preventing liquids to fuser devices with improved spatial and/or temporal control.

Thus, one important advantage of the present invention is its improvement with respect to the applicator contamination and wasted offset inhibiting oil problems that are incident to prior art applicators. Another important advantage of this invention is the capability for improved control of the offset liquid delivery. In one regard, such improved control is provided with respect to the frequency/amount parameters of the copying system, e.g. applying more in response to copies requiring more and vice versa. In another regard, improved spatial control is provided for offset liquid application, e.g. applying more, less or zero offset liquid: (i)for different copy sheet types or different copy sheet positions, and/or (ii) for different toner image portions in response to the different requirements of those image portions. A further advantage of the present invention is its capability for providing controlled amounts of such liquid in accord with particular wear patterns.

In one aspect the present invention constitutes an improved system for inhibiting toner offset in electrostatographic apparatus having means for forming images on respective copy sheets and fusing means for fusing those images to their respective copy sheets. Such system comprises: (i) drop generator means for controllably directing individual drops of offset-inhibiting liquid toward predetermined locations of an application region located along the path of movement of said fusing means, (ii) supply means for delivering offset-inhibiting liquid to said drop generator means and (iii) means for controlling the operation of said drop generator means in timed relation with the movement of said fusing means to form predetermined patterns of offset-inhibiting liquid on the surface of said fusing means.

In another aspect the present invention constitutes an improved method for inhibiting toner offset within an electrostatographic process that includes forming toner images on copy sheets and fusing the toner images to their respective sheets. Such method comprises the steps of (i) moving a fusing member past an application region, upstream of its fusing nip, at a predetermined rate and (ii) directing discretely generated drops of offset-inhibiting liquid toward predetermined locations of said application region in timed relation to the movement of said fusing member.

DESCRIPTION OF DRAWING

The subsequent description of preferred embodiments of the invention refers to the accompanying drawings wherein.

DETAILED DESCRIPTION OF THE INVENTION

Figure 1:
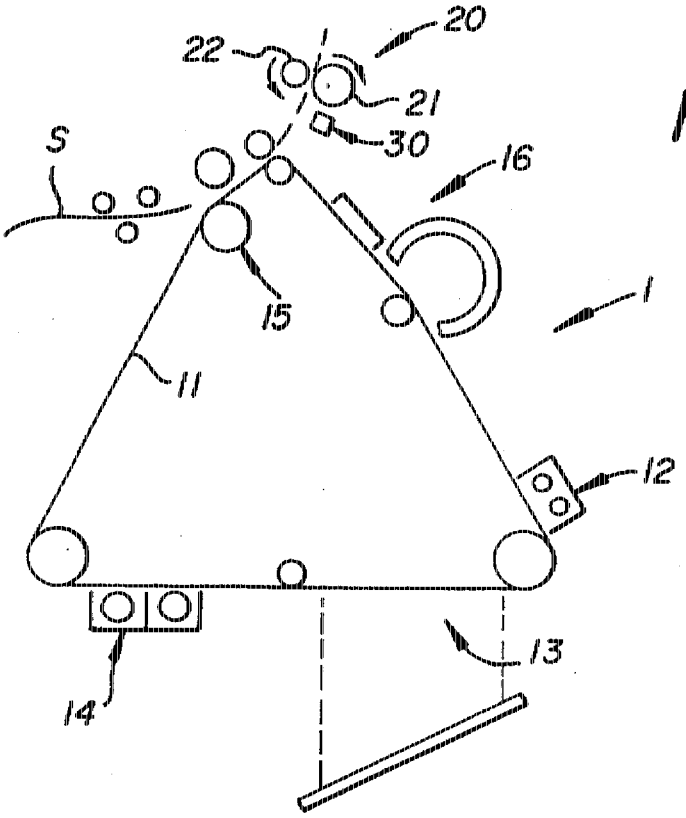
FIG. 1 is a schematic view of an electrostatographic apparatus in which the system and method of the present invention can be incorporated.

Referring briefly to FIG. 1, an offset inhibiting system 30 of the present invention is shown as it can be incorporated in an electrophotographic apparatus 1, of the kind having an endless photoconductor member 11, which moves around an endless path past a charging station 12, an exposure station 13, a developing station 14, a transfer station 15 and an erase/clean station 16. A copy sheet S is fed from a supply, not shown, to receive a toner image at transfer station 15 and then pass to fusing station 20, which comprises a fusing roller 21 and a pressure roller 22.

Figure 2:
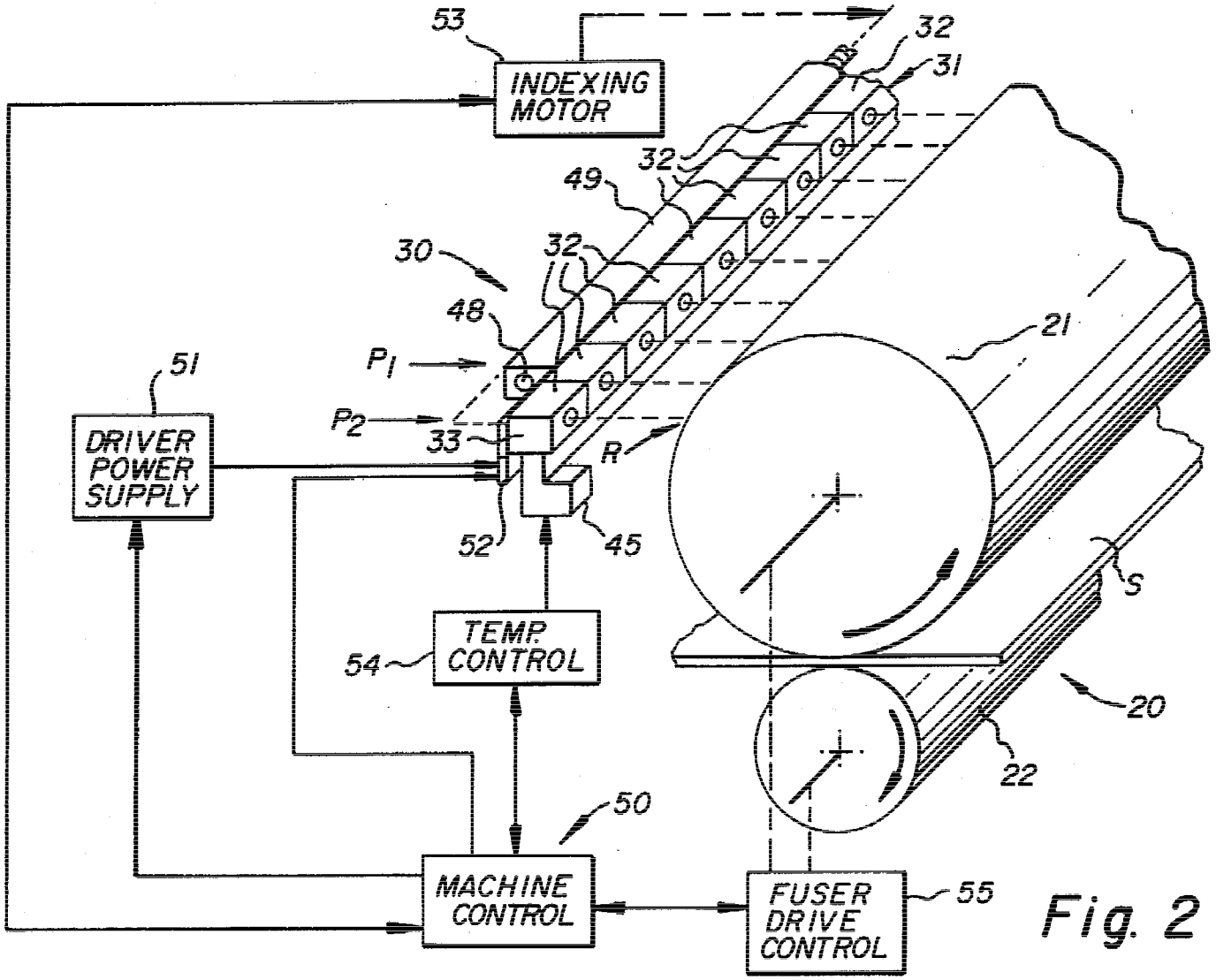
FIG. 2 is an enlarged schematic perspective view showing details of one preferred fusing system embodiment in accord with the present invention.
Figure 4:
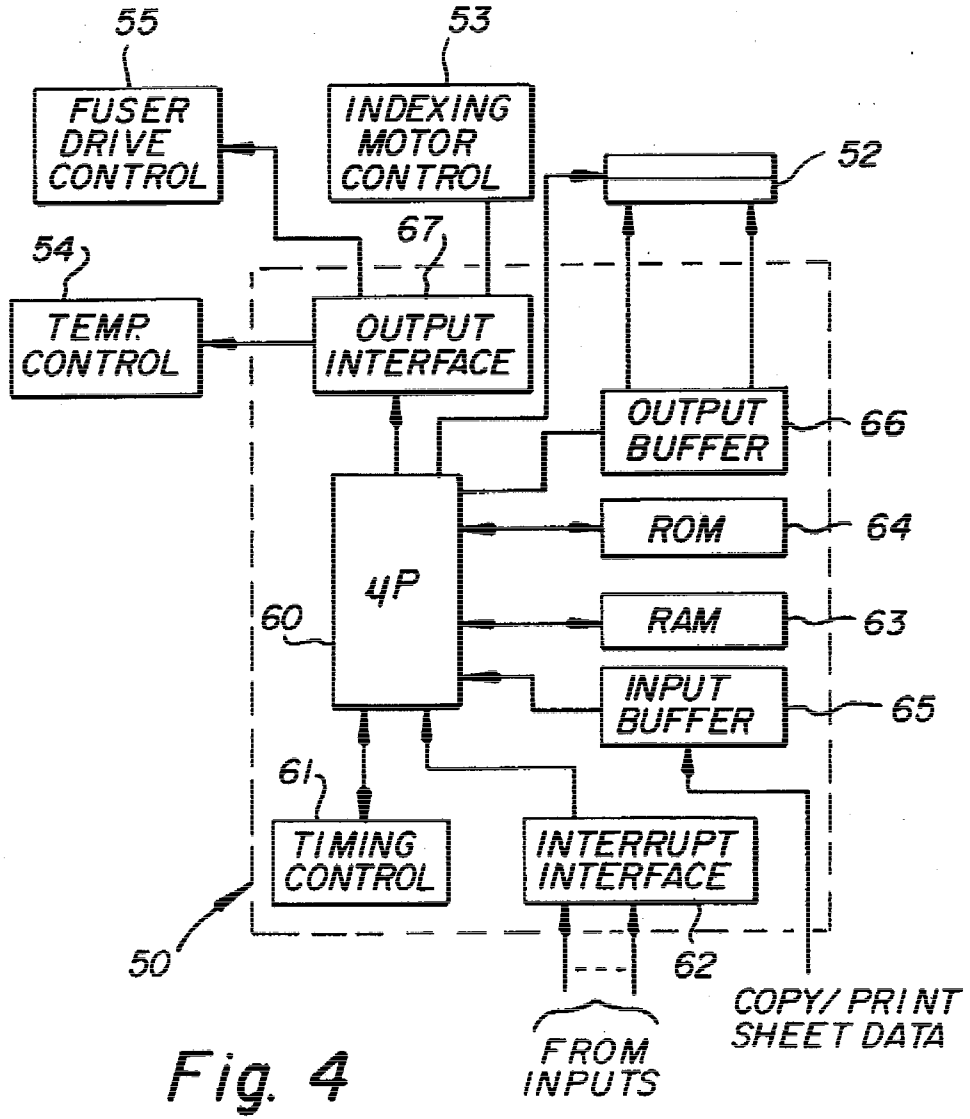

One preferred embodiment of offset inhibiting system 30 is shown schematically in more detail in FIG. 2 as it cooperates with the fusing means 20 of apparatus 1. In general, the system 30 comprises drop generator means, including an array 31 of drop generator devices 32, supply means 45 for providing such devices with offset-inhibiting liquid and control means 50 for controlling the drop generating operation of devices 32. Each of devices 32 is capable of controllably directing individual drops of offset-inhibiting liquid toward predetermined locations of an application region R along the rotational path of fusing roller 21.

Figure 3:
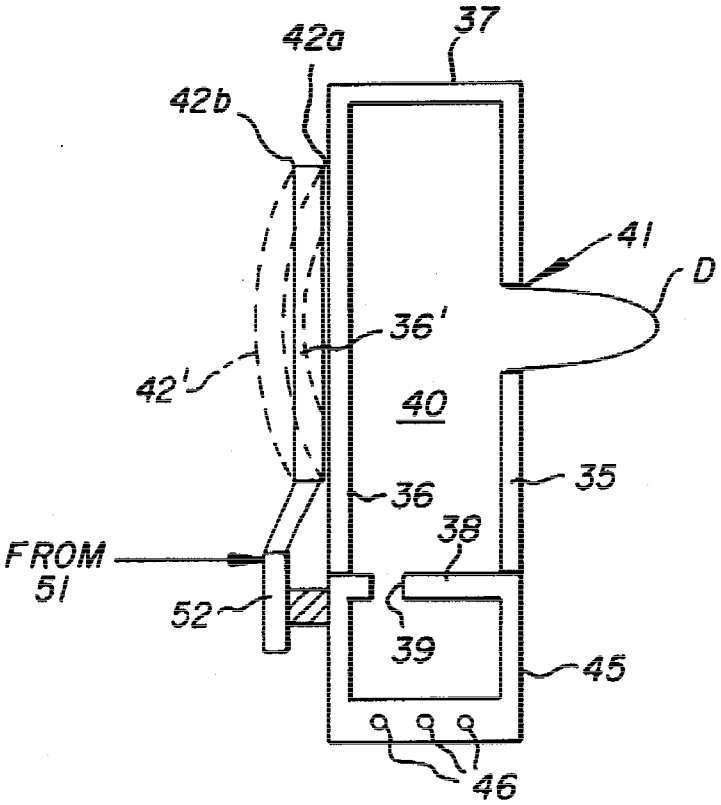
FIG. 3 is a further enlarged cross-sectional view of one preferred drop generator embodiment in accord with the present invention.

FIG. 3 shows the cross-section of one of the drop-on-demand generators 32 in more detail. This preferred embodiment comprises opposing front and rear wall members 35, 36 and top and bottom wall portions 37, 38, which together with end walls 33 define liquid chamber 40. The front wall portion defines a drop ejection orifice 41 and the rear wall has a section which is bendable in response to the change in length of thin piezoelectric element 42 that is laminated to its exterior side. The drop generator can have other forms, e.g. having the rear wall itself formed of a piezoelectric material (see U.S. Pat. No. 4,825,227) or using a rear wall pusher element (see U.S. Pat. No. 5,124,716). In each embodiment the piezoelectric transducer is actuated by an applied voltage across appropriate sections thereof, e.g. by means of surface electrodes **42*a*, 42*b*, to expand and contract and displace rear wall 36 first away from and them back toward the chamber 40. The increase of the volume of chamber 40 induces liquid to fill chamber through passage 39. The chamber contraction ejects a drop of liquid 60, forcefully through the orifice along a flight path directed toward the fuser roller 21**.

Thus, the applicator head shown in FIG. 3 uses a fill-before-fire sequence so that the energizing pulse moves the piezoelectric transducer 42 and the coupled wall 36 to the dotted line position shown in FIG. 3 to draw additional liquid into chamber 40. Upon termination of the electrical pulse the restoring forces of the wall and transducer move to the solid line position shown in FIG. 3 to eject a drop D. This "fall-before-fire" mode is useful to allow actuations in the 10–20 microsecond range. Where less rapid drop ejection rates are required, capillary refill can be used and the electrical pulse can actuate the piezoelectric bender to eject drops. Also where refill rates and the liquid medium permit, thermal drop-on-demand generators, such as used in thermal jet ink printing can be utilized to construct the array 31. Continuous drop generator may be used in certain applications, however, piezoelectric drop-on-demand generators are preferred for practice of the invention.

The electrical pulses for actuating drop generators of array 31 can be provided by a high voltage driver power supply 51 (see FIG. 2) under the control of a circuit chip 52 such as a serial in parallel out shift register, which operates in accord with signals provided from main control 50, as described in more detail below.

The offset inhibiting liquid is supplied to each of the drop generator chambers 40 from a supply manifold 45 that extends along the length of the generator array 31 beneath the chambers. In some preferred embodiments it is desirable to provide resistance heater elements 46 in the manifold 45 to heat the supplied liquid to a desired temperature and viscosity.

As shown in FIG. 2, the drop generator array 31, with its coupled driver electronics 52 and liquid supply manifold 45 is mounted for indexing movement with respect to the fuser roller 21. More specifically, a helical drive screw 47 supports the drop generator assembly 31 within the threaded bore 48 of flange 49. When the indexing motor 53 rotates screw 47, the entire drop generator assembly translates in a direction parallel to the axis of rotation of fuse roller 21, to index respective drop generator orifices into different drop addressing positions vis a vis the drop application region R along the path of travel of the fuse roller surface.

The machine control 50 of the electrophotographic apparatus can be a microprocessor control system which controls the functions of many aspects of the apparatus beyond the fuse and offset inhibiting system of this invention. Control 50 includes a microprocessor 60 with related timing control and interrupt interface sections 61, 62 and cooperative read write memory (RAM) 63 read only memory (ROM) 64. The control system also can include input and output buffer sections 65, 66 for receiving and storing data and an output interface 67 for directing signals to machine control subsystems such as temperature control 54, indexing motor-control 53 and fuser drive control 55.

The functioning and construction of the offset inhibiting system and process of the present invention will be further appreciated by considering one mode of operation. Thus, the electrophotographic apparatus operates under the control of instructions in ROM 64 to form an electrostatic image, develop it with charged toner particles and transfer the toner image to a copy sheet S directed toward the nip of fuser roller 21 and pressure roller 22. At this stage the microprocessor 60 has received input data about the nature of the copy sheet and/or the nature of the toner image on the copy sheet. For example, the input information can comprise copy sheet size signals, copy sheet position signals, copy sheet orientation signals (i.e. landscape or portrait), copy sheet composition signals (plain paper, coated paper, transparency, etc) or copy sheet weight signals, which can be produced in response to operator selections. When the toner image is based on electronic digital data, the input information can comprise detail (e.g. bit-map) information about the toner image, including for example, its alpha numeric composition, its margins, its solid area content, its half-tone content, its continuous tone content, its line content and its different color toners contents. In optical copiers, photoelectric or electrostatic detectors can sense developed toner or latent electrostatic images to provide similar input information about image contents to the machine control 50 via interrupt interface 62. Such input information is processed by the microprocessor 60 according to routines from ROM 64 and data for controlling the application of offset liquid to fuser roller 21 is devised and stored in RAM 63, to be output to output buffer 66 and/or shift register 52, in timed relation with the passage of the copy sheet S through the fuser roller.

In response to control signals from machine control 50, the drop generators of array 31 are selectively operated to direct line by line drop patterns of offset inhibiting oil onto the respective linear sections of the surface of fuser roller 21 that sequentially pass application region R on their way to contact with the toner image on sheet S at the fusing nip formed with pressure roller 22. The movement of the fuser roller surface 21 is controlled by its drive control 55 as coordinated by machine control 50 to be in proper timed relation with the drop generator actuations. One skilled in the art will appreciate that the array 31 could alternatively be directed at the pressure roller 22 or another member that could transfer its deposited pattern of liquid to roller 21.

Figure 5:
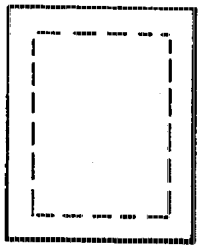
FIG. 4 is a schematic diagram of one preferred control system for practice of the present invention and FIGS. 5–7 are diagrams illustrating different copy sheet examples that can be advantageously treated in different ways in accord with the present invention.
Figure 6:
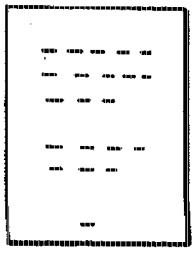
Figure 7:
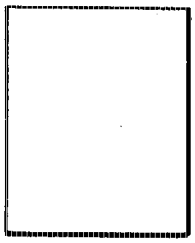

In the preferred embodiment shown in FIG. 2, the drop generator array 31 is indexed laterally to increase the resolution of the offset inhibiting drop pattern that is applied. The drop generator actuating signals can be scheduled to shift register 52 to effect the desired drop pattern in proper preceding timed relations to the respective portions of a copy sheet with which they are intended to interface. For example, if the input signals indicates an alpha numeric text sheet having margins such as shown in FIG. 5 by dotted lines, the output data to shift register 52 can comprise fire/no-fire signals that will cause the drop generators to apply offset inhibiting oil only within the area of the fuser roller that will contact the copy sheet area within the (dotted line) margins of the FIG. 5 sheet. Similarly application patterns can be signalled to correspond to only the line portions of text shown on the copy sheet in FIG. 6 or to correspond to a full page continuous or half-tone, black and white or color image, schematically illustrated by FIG. 7. Additionally, the machine control can effect application of different quantities of offset inhibiting liquid to different sheet regions, e.g. the sheet lead edge region which usually experiences increased offset difficulties, or to fuser roller regions juxtaposed to copy sheet edges, to reduce fuser wear.

It will be appreciated that the above described system provides significant advantages by facilitating the controlled application of offset inhibiting liquid to fuser rollers. Preferred liquids for use in systems of the present invention are silicone oils. The selection of such oils can be made, considering the desired degree of heating within the supply means and the oil's room temperature viscosity, to provide a supplied liquid viscosity suitable for drop formation and jetting, as well as surface coverage of the fuser members. With piezoelectric drop-on-demand devices such as shown in FIG. 3, preferred room temperature oil viscosities can be in the range from about 5 centistokes (cs) to about 350 cs and heated oil temperature in the range from about 25° centigrade to 180° centigrade. For example, an oil of about 20 cs might be heated in the supply means to about 100° centigrade, with higher viscosity oils heated to higher temperatures and lesser viscosity oils heated to lesser temperatures. Thus, preferred viscosities of oil within the heated supply chamber may be in the range from about 1 cs to 100 cs.

Useful offset inhibiting oil coverages upon the fuser member can vary greatly, e.g. within the range from about 0.1 to about 10 milligrams per square foot. A typical coverage rate for application within the margins of a conventional text copy sheet could be about 1 milligram per square foot. Such coverages can be achieved by coordinating the drop volume and drop emission rate with the surface velocity of the fuser member and the transverse indexing of the drop generator array. Typical drop volumes can be in the range from about 75 to about 150 picoliters and typical drop emission rates can be in the range of about to 5 to about 10 kilohertz. However, other drop volumes and drop rates can be utilized. Array to fuser surface spacings can be, e.g., from about 0.2 to about 2 centimeters and drop speeds can be from about 5 to about 15 meters per second; however other spacings and speeds will also be found useful.

One particularly preferred system comprises polydimethylsiloxane offset inhibiting liquid having a room temperature viscosity of 20 cs. The liquid is supplied to manifold 45 and heated by elements 46 to about 100 degrees centigrade. The liquid can be delivered with drop sizes, speeds, and emission rates within the above ranges to achieve varying surface coverages depending upon the requirements presented by different copy sheets.

The invention has been described in detail with particular reference to preferred embodiments, but it will be understood that variations and modifications can be effected within the spirit and scope of the invention.

We claim:

1. In electrostatographic apparatus having means for forming toner images on respective copy sheets and fusing means, including a moving contact surface, for fusing such toner images onto those copy sheets, a system for inhibiting toner offset, said system comprising:

a. drop generator means for controllably directing individual drops of offset-inhibiting liquid toward predetermined locations of an application region located along the movement path of said fusing means;

b. supply means for delivering offset-inhibiting liquid to said drop generator means; and c. control means for controlling the operation of said drop generator means in timed relation with the movement of said fusing means to form predetermined patterns of offset-inhibiting liquid on the contact surface of said fusing means, said control means including memory means for receiving and storing signals indicating particular copy sheet conditions and pattern control means for changing the patterns of applied drops in response signals in said memory means, wherein said control means receives signals indicating the weight of copy sheets and controls the pattern of applied drops to vary the applied amount of offset inhibiting oil in an inverse relation to the sheet weight.

2. The invention defined in claim 1 wherein said drop generator means comprises a drop-on-demand device.

3. The invention defined in claim 2 wherein said device includes a piezoelectric drop actuator.

4. The invention defined in claim 1 wherein supply means includes heating means for providing offset-inhibiting liquid to said drop generators at a temperature that enables a drop-forming viscosity.

5. In electrostatographic apparatus having means for forming toner images on respective copy sheets and fusing means, including a moving contact surface, for fusing such toner images onto those copy sheets, a system for inhibiting toner offset, said system comprising:

a. drop generator means for controllably directing individual drops of offset-inhibiting liquid toward predetermined locations of an application region located along the movement path of said fusing means;

b. supply means for delivering offset-inhibiting liquid to said drop generator means; and c. control means for controlling the operation of said drop generator means in timed relation with the movement of said fusing means to form predetermined patterns of offset-inhibiting liquid on the contact surface of said fusing means, said control means including memory means for receiving and storing signals indicating particular copy sheet conditions, wherein said control means receives and stores signals indicating the size of copy sheets and controls the pattern of applied drops to correspond to the particular size copy sheet contacting the fusing means, and pattern control means for changing the patterns of applied drops in response signals in said memory means, wherein said control means varies the amount of oil applied within the roller surface corresponding to a copy sheet.

6. The invention defined in claim 5 wherein said control means varies the amount of such oil applied to be greater in areas corresponding to the copy sheet lead surface regions.

7. The invention defined in claim 5 wherein said control means varies the amount of said oil applied to be less along copy sheet margin areas.

8. The invention defined in claim 5 wherein said control means receives signals indicative of the contents of particular toner images and said patterns of applied oil are tailored to respective toner images.

9. The invention defined in claim 8 further including signalling means for providing bit map data of the toner image content.

10. The invention defined in claim 8 further including signalling means for providing color content data with respect to the toner image.

11. The invention defined in claim 8 wherein said control means receives and stores signals indicating the orientation of copy sheets and controls the pattern of applied drops to correspond to the particular copy sheet orientation that contacts said fusing means.

12. In a process of producing electrostatographic copies that includes forming a toner image electrostatically attracted to a copy sheet and contact fusing the toner image to the copy sheet, an improved offset inhibiting method comprising the steps of:

(i) moving a fusing member at a predetermined rate past an application region, upstream of its region for contact with the copy sheets;

(ii) directing discretely generated drops of offset inhibiting liquid toward predetermined locations of said application region in predetermined timed relations to the movement of said fusing member; and (iii ) controlling the generation of drop in accordance with copy sheet weight.

13. The method defined in claim 12 wherein said drop-directing step comprises supplying offset inhibiting liquid to an orificed chamber and piezoelectrically changing the volume of said chamber to eject a drop of such liquid.

14. The method defined in claim 12 further comprising the step of controlling the generation of drop in accordance with copy sheet size.

15. The invention defined in claim 12, wherein said liquid is silicone oil and further comprising the step of heating the silicone oil prior to its drop ejection.

16. In a process of producing electrostatographic copies that includes forming a toner image electrostatically attracted to a copy sheet and contact fusing the toner image to the copy sheet, an improved offset inhibiting method comprising the steps of:

(i) moving a fusing member at a predetermined rate past an application region, upstream of its region for contact with the copy sheets;

(ii) directing discretely generated drops of offset inhibiting liquid toward predetermined locations of said application region in predetermined timed relations to the movement of said fusing member; and (iii) controlling the generation of drop in accordance with the contents of the toner pattern on individual sheets.

17. In a process of producing electrostatographic copies that includes forming a toner image electrostatically attracted to a copy sheet and contact fusing the toner image to the copy sheet, an improved offset inhibiting method comprising the steps of:

(i) moving a fusing member at a predetermined rate past an application region, upstream of its region for contact with the copy sheets;

(ii) directing discretely generated drops of offset inhibiting liquid toward predetermined locations of said fusing member; and, (iii) controlling the generation of drops in accordance with fuser roller wear patterns.

* * * * *

UNITED STATES PATENT AND TRADEMARK OFFICE

CERTIFICATE OF CORRECTION

PATENT NO. : 5,708,914
DATED : 13 January 1998
INVENTOR(S) : Borden H. Mills, et al It is certified that error appears in the above-identified patent and that said Letters Patent is hereby corrected as shown below:

| | |
|---|---|
| Title Page | insert --Section [60] Provisional application No. 60/004,051 Sept. 20, 1995.-- |

Signed and Sealed this

Twenty-sixth Day of May, 1998

*Attest:*

*Attesting Officer*

BRUCE LEHMAN

*Commissioner of Patents and Trademarks*